US010625105B2

(12) United States Patent
Hetrich et al.

(10) Patent No.: US 10,625,105 B2
(45) Date of Patent: Apr. 21, 2020

(54) HARNESS CONNECTOR

(71) Applicant: MSA Technology, LLC, Cranberry Township, PA (US)

(72) Inventors: Mitchell H. Hetrich, Greenville, PA (US); Robert Pitt, Glenshaw, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 226 days.

(21) Appl. No.: 15/818,110

(22) Filed: Nov. 20, 2017

(65) Prior Publication Data

US 2019/0070443 A1 Mar. 7, 2019

Related U.S. Application Data

(63) Continuation-in-part of application No. 15/698,264, filed on Sep. 7, 2017.

(51) Int. Cl.
*A62B 35/00* (2006.01)
*E05D 11/00* (2006.01)

(52) U.S. Cl.
CPC ..... *A62B 35/0037* (2013.01); *A62B 35/0031* (2013.01); *A62B 35/0043* (2013.01)

(58) Field of Classification Search
CPC ..... A44B 13/00; A44B 11/28; A62B 35/0037
See application file for complete search history.

(56) References Cited

U.S. PATENT DOCUMENTS 3,188,686 A * 6/1965 Orcutt ..... E05D 5/128 16/263
3,545,776 A 12/1970 Haviland
3,621,512 A * 11/1971 Johnson ..... E05D 5/128 16/380
5,433,547 A * 7/1995 Hart ..... F16B 39/32 403/154
6,007,268 A 12/1999 Whittington et al.
6,317,928 B1 * 11/2001 Guillemette ..... E05D 7/1016 16/353
7,197,791 B1 * 4/2007 Smith ..... E05D 11/06 16/334
7,540,140 B1 * 6/2009 Diaz ..... F16G 15/06 403/154
8,082,628 B2 * 12/2011 Chiang ..... G06F 1/1681 16/312
8,307,513 B1 * 11/2012 Fitzgerald ..... E05D 11/06 16/344

(Continued)

*Primary Examiner* — Jason W San
(74) *Attorney, Agent, or Firm* — The Webb Law Firm

(57) ABSTRACT

A connector includes a frame having a first end, a second end, and a pass-through opening extending between the first end and the second end along a longitudinal axis of the frame. The connector further has a gate positioned between the first end and the second end of the frame and movable between a closed position to close the pass-through opening and an open position to open the pass-through opening. A locking mechanism selectively locks the gate in the closed position. The locking mechanism has a rotatable knob connected to at least one of the first end and the second end of the frame and rotatable in a direction about the longitudinal axis, and a locking indent on the gate configured for receiving at least a portion of the rotatable knob when the gate is in the closed position. The rotatable knob is rotationally biased by a biasing mechanism.

24 Claims, 11 Drawing Sheets

(56) References Cited

U.S. PATENT DOCUMENTS

| | | | | |
|---|---|---|---|---|
| 8,327,505 | B2 * | 12/2012 | Smith | E05D 3/02 16/374 |
| 8,938,864 | B2 | 1/2015 | Casebolt | |
| 9,435,484 | B1 | 9/2016 | Yang et al. | |
| 9,665,130 | B2 * | 5/2017 | Hu | G06F 1/1681 |
| 10,143,866 | B2 * | 12/2018 | Yang | A62B 35/0037 |
| 2006/0099838 | A1 | 5/2006 | Meyers | |
| 2008/0235907 | A1 * | 10/2008 | Wayman | E05D 7/105 16/361 |
| 2009/0151124 | A1 * | 6/2009 | Forrest | E05D 5/14 16/374 |
| 2010/0251520 | A1 * | 10/2010 | Corso | E05D 5/12 16/342 |
| 2010/0269298 | A1 * | 10/2010 | Chiang | G06F 1/1616 16/361 |
| 2012/0240354 | A1 * | 9/2012 | Heninger | E05D 5/10 16/374 |
| 2012/0272477 | A1 * | 11/2012 | Mirick | E05D 11/00 16/274 |
| 2013/0074469 | A1 * | 3/2013 | Robins | F16G 15/06 59/86 |
| 2015/0160695 | A1 * | 6/2015 | Su | G06F 1/1618 16/366 |
| 2017/0319880 | A1 * | 11/2017 | Yang | A62B 35/0037 |

* cited by examiner

HARNESS CONNECTOR

CROSS-REFERENCE TO RELATED APPLICATIONS

This application is a continuation-in-part of and claims priority to U.S. patent application Ser. No. 15/698,264, filed on Sep. 7, 2017 and entitled "Harness Connector", the disclosure of which is incorporated by reference herein in its entirety.

BACKGROUND OF THE INVENTION

Field of the Invention

The present disclosure pertains broadly to the field of mechanical connectors. More specifically, the present disclosure relates to mechanical connectors suitable for use in fall-arresting or fall prevention applications.

Background of the Invention

In various applications, safety harnesses are used in work environments where there may be a risk of falling from an elevated position. In some applications, a user wearing a safety harness may be connected to a lanyard that is then attached to an anchor point. The lanyard is attached to the harness with a connector which is configured for removably connecting the safety harness with the lanyard.

A wide variety of connectors exists for various applications. In some examples, the connector is movable between a first position, where the connector securely connects the safety harness to the lanyard, and a second position, where the connector allows the safety harness to be disconnected from the lanyard. A two-action locking mechanism may be provided with some connectors to prevent inadvertent movement between the first and second positions. In some examples, the two-action locking mechanism may require two discrete actions by the user, such as two pulling, pushing, and/or twisting actions. A third action mechanism may be provided to open the connector from the first position to the second. For example, two discrete actions may be required to unlock the locking mechanism, while a third action is necessary to open the connector to allow the connector to be connected to the lanyard. Many of the existing connector designs are difficult to use when operating the two-action locking mechanism then to move the connector between the first and second position. Some connectors require the unlocking to be performed using both hands, thereby making it difficult to open the unlocked connector because the user does not have a free hand. Accordingly, there is a need in the art for an improved connector that overcomes the deficiencies associated with the existing devices.

SUMMARY OF THE INVENTION

Accordingly, and generally, provided is an improved connector for use in a fall arresting or fall protection system. Preferably, provided is an improved connector that overcomes the deficiencies of existing connectors.

According to some non-limiting embodiments or aspects, a connector may include a frame having a first end, a second end, and a pass-through opening extending between the first end and the second end along a longitudinal axis of the frame. The connector further may include a gate positioned between the first end and the second end of the frame and movable between a closed position to close the pass-through opening and an open position to open the pass-through opening. The connector further may include a locking mechanism for selectively locking the gate in the closed position. The locking mechanism may have a rotatable knob connected to at least one of the first end and the second end of the frame and rotatable in a direction about the longitudinal axis and a locking indent on the gate configured for receiving at least a portion of the rotatable knob when the gate is in the closed position. The locking indent may have a curved sloped portion arranged at an angle relative to a longitudinal axis of the gate and a recess arranged substantially perpendicular to the longitudinal axis of the gate.

According to some non-limiting embodiments or aspects, in the closed position, the gate may be connected to the first end and the second end of the frame, and, in the open position, the gate may be disconnected from at least one of the first end and the second end of the frame. The rotatable knob may be rotatable between a first position permitting longitudinal movement of the gate between the first end and the second end of the frame and a second position preventing longitudinal movement of the gate when the gate is in the closed position. The rotatable knob may have a pin positioned within at least one of the first end and the second end of the frame. The rotatable knob may be biased to the second position by a first biasing member, such as a spring.

According to some non-limiting embodiments or aspects, an outer sleeve surrounding at least a portion of the rotatable knob may be provided. The outer sleeve may be axially movable relative to the rotatable knob between a first position and a second position, wherein, in the first position of the outer sleeve, rotational movement of the rotatable knob is prevented, and wherein, in the second position of the outer sleeve, rotational movement of the rotatable knob is permitted. The outer sleeve may be operatively connected with the rotatable knob in the second position of the outer sleeve to permit rotational movement of the rotatable knob with rotational movement of the outer sleeve. The outer sleeve may be axially biased to the first position by a second biasing member.

According to some non-limiting embodiments or aspects, the gate may have an elongated, substantially cylindrical body with a first end and a second end spaced apart along a longitudinal axis of the gate. The locking indent may be positioned at one of the first end and the second end of the gate. The locking indent may have a sloped portion arranged at an angle relative to the longitudinal axis of the gate and a recess arranged substantially perpendicular to the longitudinal axis of the gate. The recess may prevent opening of the gate without rotation of the rotatable knob. The sloped portion may be configured to automatically rotate the rotatable knob to receive the gate when the gate is pushed to a closed position. The locking indent may have a gap between the curved sloped portion and a sidewall of the gate and wherein a pin of the rotatable knob is guided within the gap along the curved sloped portion. The cylindrical body of the gate may be movable within a bore extending through the first end of the frame. The gate may have a track extending between the first end and the second end in a direction of the longitudinal axis. The frame may have a detent within the bore of at least one of the first end and the second end of the frame, the detent being received within the track of the gate to delimit longitudinal and rotational movement of the gate relative to the frame. The frame may have an attachment portion with an opening for receiving at least an element of a fall arrest system.

According to some non-limiting embodiments or aspects, a connector may have a frame having a first end, a second end, and a pass-through opening extending between the first end and the second end along a longitudinal axis of the frame. The connector further may include a gate positioned between the first end and the second end of the frame. The gate may have an elongated, substantially cylindrical body with a first end and a second end spaced apart along a longitudinal axis of the gate. The gate may be movable between a closed position, wherein the gate is connected to the first end and the second end of the frame, and an open position, wherein the gate is disconnected from at least one of the first end and the second end of the frame. The connector may further include a locking mechanism for selectively locking the gate in the closed position. The locking mechanism may include a rotatable knob connected to at least one of the first end and the second end of the frame and rotatable in a direction about the longitudinal axis between a first position permitting longitudinal movement of the gate between the first end and the second end of the frame and a second position preventing longitudinal movement of the gate when the gate is in the closed position. The rotatable knob may have a pin positioned within a bore of at least one of the first end and the second end of the frame. The locking mechanism may further have locking indent on one of the first end and the second end of the cylindrical body of the gate. The locking indent may be configured for receiving the pin of the rotatable knob when the gate is in the closed position. The locking indent may have a curved sloped portion arranged at an angle relative to the longitudinal axis of the gate and a recess arranged substantially perpendicular to the longitudinal axis of the gate, the recess configured for receiving the pin of the rotatable knob when the gate is in the closed position. The rotatable knob may be biased to the second position by a first biasing member, such as a spring.

According to some non-limiting embodiments or aspects, the cylindrical body of the gate may be movable within a bore extending through the first end and the second end of the frame. The gate may have a track extending between the first end and the second end in a direction of the longitudinal axis. The frame may have a detent within the bore of at least one of the first end and the second end of the frame. The detent may be received within the track of the gate to delimit longitudinal and rotational movement of the gate relative to the frame.

According to some non-limiting embodiments or aspects, an outer sleeve surrounding at least a portion of the rotatable knob may be provided. The outer sleeve may be axially movable relative to the rotatable knob between a first position and a second position, wherein, in the first position of the outer sleeve, rotational movement of the rotatable knob is prevented, and wherein, in the second position of the outer sleeve, rotational movement of the rotatable knob is permitted. The outer sleeve may be operatively connected with the rotatable knob in the second position of the outer sleeve to permit rotational movement of the rotatable knob with rotational movement of the outer sleeve. The outer sleeve may be axially biased to the first position by a second biasing member.

According to some non-limiting embodiments or aspects, a connector may include a frame having a first end, a second end, and a pass-through opening extending between the first end and the second end. The connector may further include a gate positioned between the first end and the second end of the frame and movable between a closed position to close the pass-through opening and an open position to open the pass-through opening. The connector may further include a locking mechanism for selectively locking the gate in the closed position. The locking mechanism may include a rotatable knob connected to at least one of the first end and the second end of the frame and rotatable in a direction about the longitudinal axis. The rotatable knob may have a pin positioned within a bore of at least one of the first end and the second end of the frame. The locking mechanism may include an outer sleeve surrounding at least a portion of the rotatable knob, the outer sleeve axially movable relative to the rotatable knob between a first position and a second position. In the first position of the outer sleeve, rotational movement of the rotatable knob may be prevented, and in the second position of the outer sleeve, rotational movement of the rotatable knob may be permitted. The locking mechanism further may have a locking indent on the gate configured for receiving the pin of the rotatable knob when the gate is in the closed position. The locking indent may have a curved sloped portion arranged at an angle relative to a longitudinal axis of the gate and a recess arranged substantially perpendicular to the longitudinal axis of the gate, wherein the recess is configured for receiving the pin of the rotatable knob when the gate is in the closed position. The rotatable knob may be rotationally biased by a biasing mechanism, such as a spring.

Further embodiments or aspects of the present disclosure are set forth in the following numbered clauses.

Clause 1: A connector comprising: a frame having a first end, a second end, and a pass-through opening extending between the first end and the second end along a longitudinal axis of the frame, a gate positioned between the first end and the second end of the frame and movable between a closed position to close the pass-through opening and an open position to open the pass-through opening; and a locking mechanism for selectively locking the gate in the closed position, the locking mechanism comprising: a rotatable knob connected to at least one of the first end and the second end of the frame and rotatable in a direction about the longitudinal axis; and a locking indent on the gate configured for receiving at least a portion of the rotatable knob when the gate is in the closed position, the locking indent comprising a curved sloped portion arranged at an angle relative to a longitudinal axis of the gate and a recess arranged substantially perpendicular to the longitudinal axis of the gate.

Clause 2: The connector of clause 1, wherein, in the closed position, the gate is connected to the first end and the second end of the frame, and wherein, in the open position, the gate is disconnected from at least one of the first end and the second end of the frame.

Clause 3: The connector of clause 1 or 2, wherein the rotatable knob is rotatable between a first position permitting longitudinal movement of the gate between the first end and the second end of the frame and a second position preventing longitudinal movement of the gate when the gate is in the closed position.

Clause 4: The connector of any of clauses 1-3, wherein the rotatable knob comprises a pin positioned within at least one of the first end and the second end of the frame.

Clause 5: The connector of any of clauses 1-4, wherein the rotatable knob is biased to the second position by a first biasing member.

Clause 6: The connector of any of clauses 1-5, wherein the first biasing member is a spring.

Clause 7: The connector of any of clauses 1-6, further comprising an outer sleeve surrounding at least a portion of the rotatable knob, the outer sleeve axially movable relative to the rotatable knob between a first position and a second position, wherein, in the first position of the outer sleeve, rotational movement of the rotatable knob is prevented, and wherein, in the second position of the outer sleeve, rotational movement of the rotatable knob is permitted.

Clause 8: The connector of any of clauses 1-7, wherein the outer sleeve is operatively connected with the rotatable knob in the second position of the outer sleeve to permit rotational movement of the rotatable knob with rotational movement of the outer sleeve.

Clause 9: The connector of any of clauses 1-8, wherein the outer sleeve is axially biased to the first position by a second biasing member.

Clause 10: The connector of any of clauses 1-9, wherein the gate has an elongated, substantially cylindrical body with a first end and a second end spaced apart along a longitudinal axis of the gate.

Clause 11: The connector of any of clauses 1-10, wherein the locking indent is positioned at one of the first end and the second end of the gate.

Clause 12: The connector of any of clauses 1-11, wherein the locking indent comprises a gap between the curved sloped portion and a sidewall of the gate and wherein a pin of the rotatable knob is guided within the gap along the curved sloped portion.

Clause 13: The connector of any of clauses 1-12, wherein the cylindrical body of the gate is movable within a bore extending through the first end and the second end of the frame.

Clause 14: The connector of any of clauses 1-13, wherein the gate comprises a track extending between the first end and the second end in a direction of the longitudinal axis.

Clause 15: The connector of any of clauses 1-14, wherein the frame comprises a detent within a bore of at least one of the first end and the second end of the frame, the detent received within the track of the gate to delimit longitudinal and rotational movement of the gate relative to the frame.

Clause 16: The connector of any of clauses 1-15, wherein the frame has an attachment portion with an opening for receiving an element of a fall arrest system.

Clause 17: A connector comprising: a frame having a first end, a second end, and a pass-through opening extending between the first end and the second end along a longitudinal axis of the frame, a gate positioned between the first end and the second end of the frame, the gate having an elongated, substantially cylindrical body with a first end and a second end spaced apart along a longitudinal axis of the gate, the gate being movable between a closed position, wherein the gate is connected to the first end and the second end of the frame, and an open position, wherein the gate is disconnected from at least one of the first end and the second end of the frame; and a locking mechanism for selectively locking the gate in the closed position, the locking mechanism comprising: a rotatable knob connected to at least one of the first end and the second end of the frame and rotatable in a direction about the longitudinal axis between a first position permitting longitudinal movement of the gate between the first end and the second end of the frame and a second position preventing longitudinal movement of the gate when the gate is in the closed position, the rotatable knob having a pin positioned within a bore of at least one of the first end and the second end of the frame; and a locking indent on one of the first end and the second end of the cylindrical body of the gate, the locking indent comprising a curved sloped portion arranged at an angle relative to the longitudinal axis of the gate and a recess arranged substantially perpendicular to the longitudinal axis of the gate, the recess configured for receiving the pin of the rotatable knob when the gate is in the closed position, wherein the rotatable knob is biased to the second position by a first biasing member.

Clause 18: The connector of clause 17, wherein the first biasing member is a spring.

Clause 19: The connector of clause 17 or 18, wherein the cylindrical body of the gate is movable within a bore extending through the first end and the second end of the frame.

Clause 20: The connector of any of clauses 17-19, wherein the gate comprises a track extending between the first end and the second end in a direction of the longitudinal axis, wherein the frame comprises a detent within the bore of at least one of the first end and the second end of the frame, and wherein the detent is received within the track of the gate to delimit longitudinal and rotational movement of the gate relative to the frame.

Clause 21: The connector of any of clauses 17-20, further comprising an outer sleeve surrounding at least a portion of the rotatable knob, the outer sleeve axially movable relative to the rotatable knob between a first position and a second position, wherein, in the first position of the outer sleeve, rotational movement of the rotatable knob is prevented, and wherein, in the second position of the outer sleeve, rotational movement of the rotatable knob is permitted.

Clause 22: The connector of any of clauses 17-21, wherein the outer sleeve is operatively connected with the rotatable knob in the second position of the outer sleeve to permit rotational movement of the rotatable knob with rotational movement of the outer sleeve.

Clause 23: The connector of any of clauses 17-22, wherein the outer sleeve is axially biased to the first position by a second biasing member.

Clause 24: A connector comprising: a frame having a first end, a second end, and a pass-through opening extending between the first end and the second end; a gate positioned between the first end and the second end of the frame and movable between a closed position to close the pass-through opening and an open position to open the pass-through opening; and a locking mechanism for selectively locking the gate in the closed position, the locking mechanism comprising: a rotatable knob connected to at least one of the first end and the second end of the frame and rotatable in a direction about a longitudinal axis, the rotatable knob having a pin positioned within a bore of at least one of the first end and the second end of the frame; an outer sleeve surrounding at least a portion of the rotatable knob, the outer sleeve axially movable relative to the rotatable knob between a first position and a second position, wherein, in the first position of the outer sleeve, rotational movement of the rotatable knob is prevented, and wherein, in the second position of the outer sleeve, rotational movement of the rotatable knob is permitted; and a locking indent on the gate comprising a curved sloped portion arranged at an angle relative to a longitudinal axis of the gate and a recess arranged substantially perpendicular to the longitudinal axis of the gate, wherein the recess is configured for receiving the pin of the rotatable knob when the gate is in the closed position.

Clause 25: The connector of clause 24, wherein the rotatable knob is rotationally biased by a biasing mechanism.

Clause 26: The connector of clause 24 or 25, wherein the biasing mechanism is a spring.

Clause 27: The connector of any of clauses 24-26, wherein the outer sleeve is axially biased to the first position by a second biasing member.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

Additional advantages and details of the invention are explained in greater detail below with reference to the exemplary embodiments or aspects that are illustrated in the accompanying schematic figures, in which.

DESCRIPTION OF THE PREFERRED EMBODIMENTS OR ASPECTS

Figure 1:
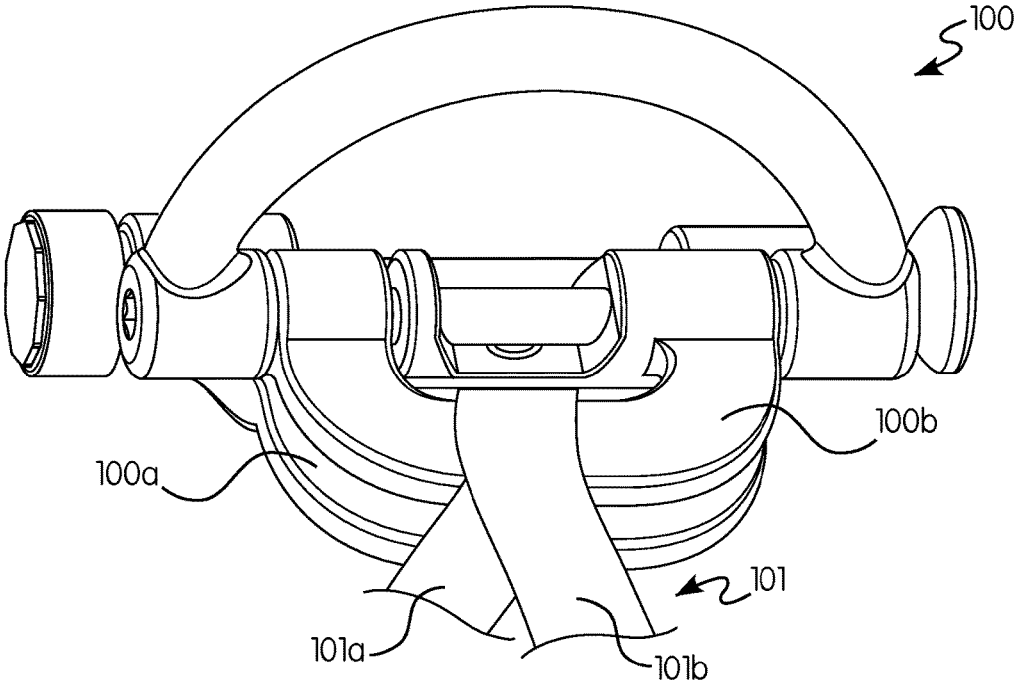
FIG. 1 is a perspective view of a harness to lanyard connector including a harness connector, energy absorber, and lanyard connector in accordance with one preferred and non-limiting example of the present invention.

Spatial or directional terms, such as "left", "right", "inner", "outer", "above", "below", and the like, are not to be considered as limiting as the invention can assume various alternative orientations. For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures.

As used in the specification and the claims, the singular form of "a", "an", and "the" includes plural referents unless the context clearly dictates otherwise.

All numbers used in the specification and claims are to be understood as being modified in all instances by the term "about". "About" means a range of plus or minus ten percent of the stated value.

Unless otherwise indicated, all ranges or ratios disclosed herein are to be understood to encompass any and all subranges or subratios subsumed therein. For example, a stated range or ratio of "1 to 10" should be considered to include any and all subranges between (and inclusive of) the minimum value of 1 and the maximum value of 10; that is, all subranges or subratios beginning with a minimum value of 1 or more and ending with a maximum value of 10 or less, such as but not limited to, 1 to 6.1, 3.5 to 7.8, and 5.5 to 10.

The terms "first", "second", and the like are not intended to refer to any particular order or chronology, but instead refer to different conditions, properties, or elements.

By "at least" is meant "greater than or equal to". By "not greater than" is meant "less than or equal to".

The term "includes" is synonymous with "comprises".

It is to be understood that the specific devices and processes illustrated in the attached drawings, and described in the following specification, are simply representative embodiments or aspects of the invention. Hence, specific dimensions and other physical characteristics related to the embodiments or aspects disclosed herein are not to be considered as limiting.

Referring to the drawings in which like reference characters refer to like parts throughout the several views thereof, the present disclosure is generally directed to a connector suitable for use in fall-arresting or fall prevention applications. With initial reference to FIG. 1, and in one non-limiting embodiment or aspect, a harness to lanyard connector 100 (hereinafter referred to as "connector 100") configured for use in a fall arrest/prevention system is shown. In various applications, the connector 100 is used to connect a harness and lanyard of the fall arrest/prevention system. The fall arrest/prevention system may be configured for use in industrial environments and recreational activities. The fall arrest/prevention system can be implemented in any appropriate application or environment where a user or worker engages in activities in an elevated position and requires protection in the event of a fall.

Figure 2:
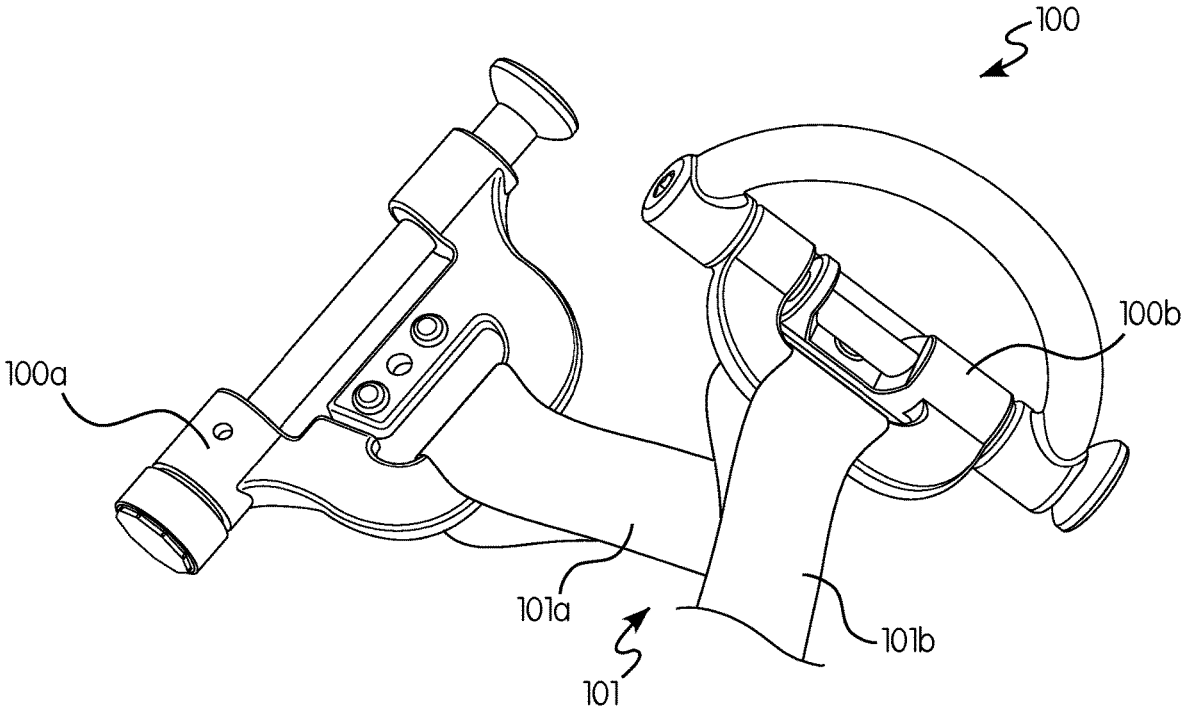
FIG. 2 is a perspective view of the harness to lanyard connector illustrated in FIG. 1 showing the harness connector and lanyard connector split into a first connector portion and a second connector portion.

With continued reference to FIG. 1, the connector 100 may have a first connector portion 100*a* (or harness connector) configured for connecting with a first portion 101*a* of the fall arrest/prevention energy absorber 101 and a second portion 100*b* (or lanyard connector) configured for connecting with a second portion 101*b* of the fall arrest/prevention energy absorber 101. In some embodiments or aspects, the first portion 100*a* and the second portion 100*b* of the connector 100 may be detachably connected to one another, such as shown in FIG. 2. In some embodiments or aspects, the first connector portion 100*a* may be configured for connecting with the first portion 101*a*, and a fall protection harness (with or without an energy absorber), while the second portion 100*b* may be configured for connecting with the second portion 101*b*, and a fall protection lanyard (with or without an energy absorber). In other embodiments or aspects, the connector 100 may only have the first connector portion 100*a*. In such embodiments or aspects, the connector 100 is connected to a fall protection harness (with or without an energy absorber) and to lanyard (with or without the energy absorber) that is connected to an anchor point.

Figure 3A:
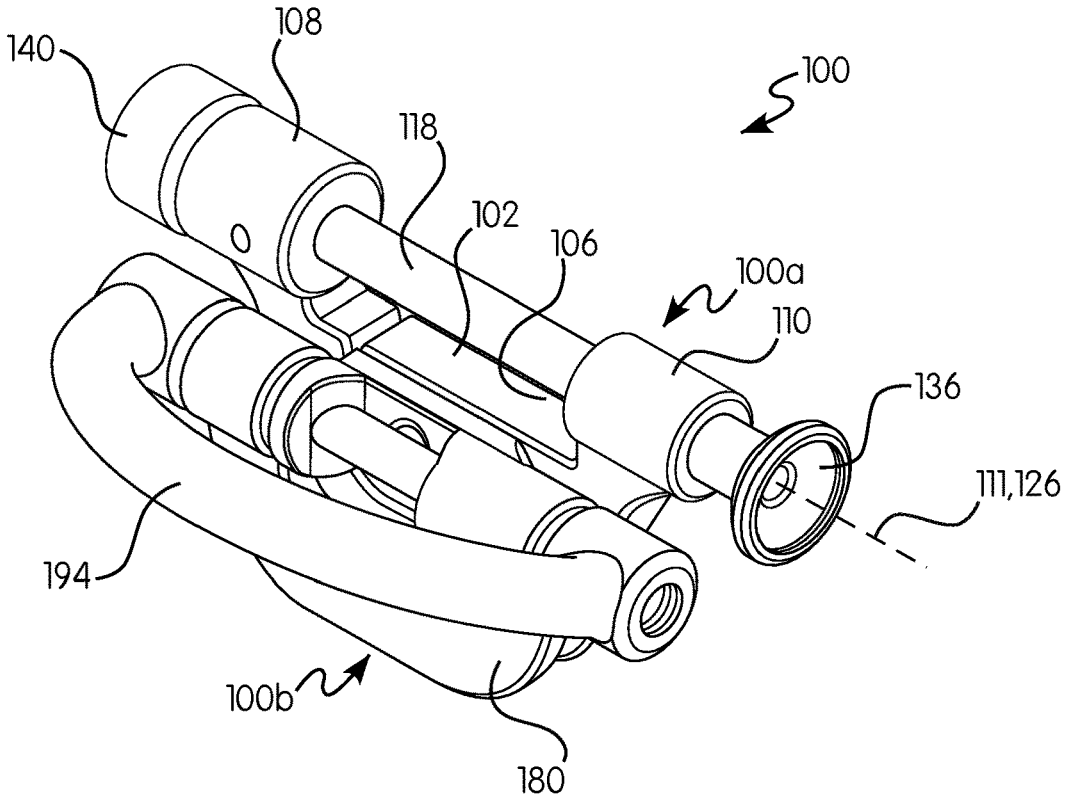
FIG. 3A is a right-side perspective view of the harness to lanyard connector illustrated in FIG. 1 without the energy absorber.
Figure 3B:
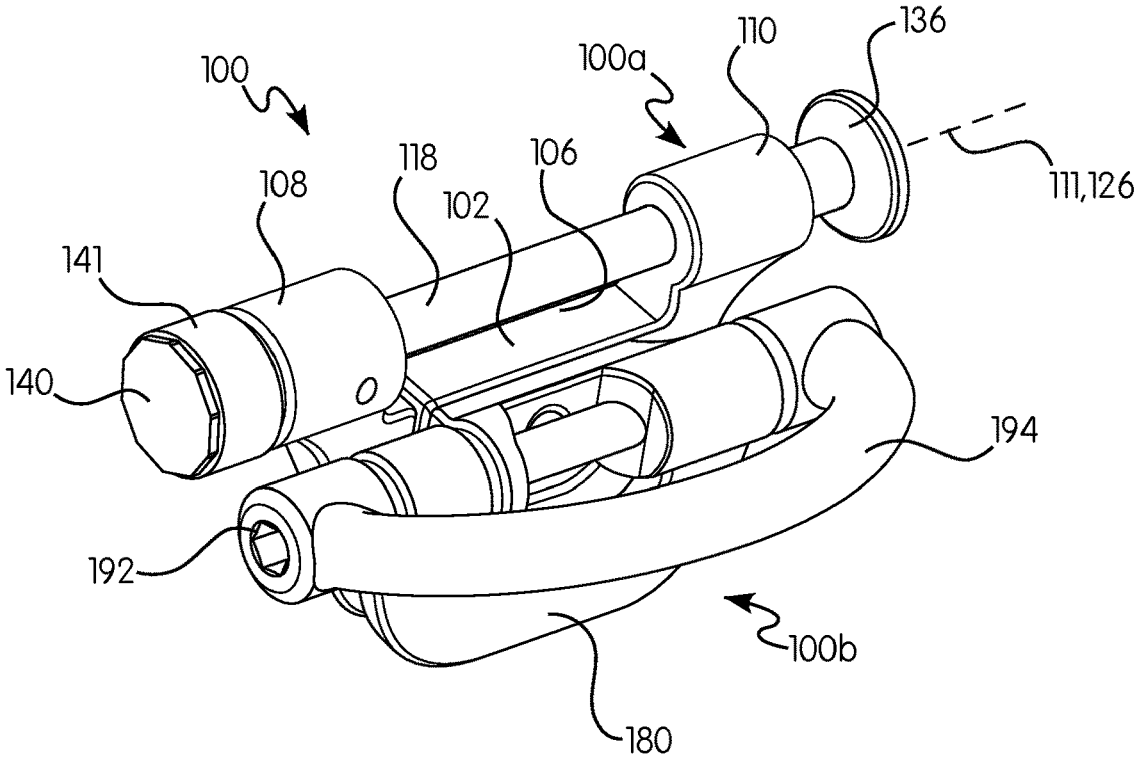
FIG. 3B is a left-side perspective view of the harness to lanyard connector illustrated in FIG. 3A.
Figure 4:
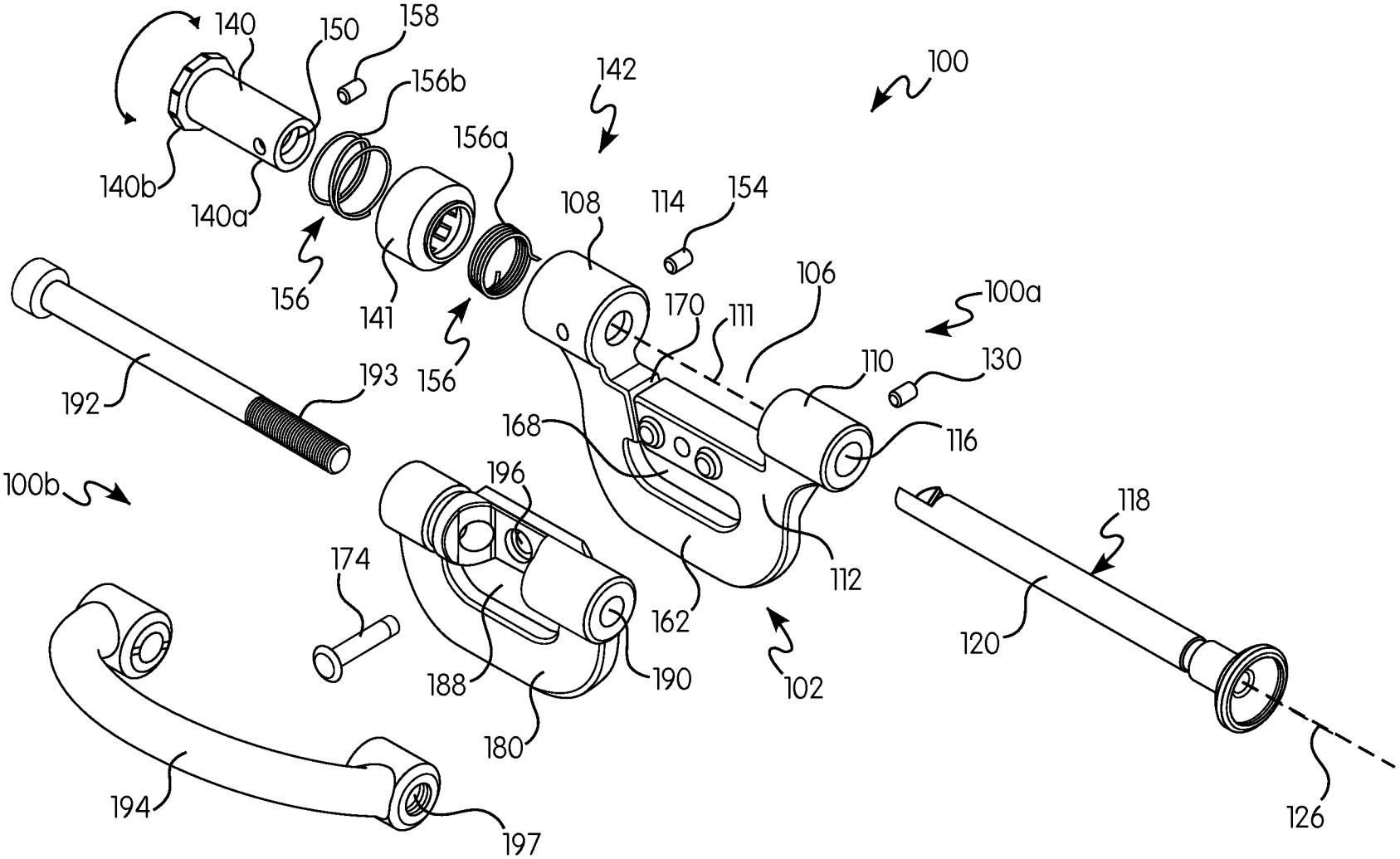
FIG. 4 is an exploded perspective view of the harness to lanyard connector illustrated in FIG. 3A.

With reference to FIGS. 3A-3B, the connector 100 is shown without the fall arrest/prevention energy absorber 101. The first portion 100*a* of the connector 100 has a frame 102 having a substantially C-shaped form. With reference to FIG. 4, which is an exploded view of the connector 100 shown in FIGS. 3A-3B, the frame 102 has a first end 108 and a second end 110 connected to opposing ends of a spine 162. The first end 108 is provided opposite the second end 110 with an opening 106 defined therebetween. The first end 108 and the second end 110 are angled relative to the spine 162 to define the C-shaped form of the connector 100. In some embodiments or aspects, the first end 108 and the second end 110 may be arranged perpendicularly relative to the spine 162. In other embodiments or aspects, at least one of the first end 108 and the second end 110 may be arranged at an acute or obtuse angle relative to the spine 162.

The first end 108 and the second end 110 may be formed monolithically with the spine 162 such that the frame 102 is formed as a single, unitary component. In some embodiments or aspects, the first end 108 and the second end 110 may be formed separately from the spine 162 and removably or non-removably attached thereto. For example, the first end 108 and the second end 110 may connected to the spine 162 by welding, one or more fasteners, or other mechanical connection. The first end 108, the second end 110, and/or the spine 162 may have a uniform or non-uniform cross-sectional shape along the length thereof. The frame 102 may be made from metal, composite, combination of metal and composite, or other heavy duty material capable of withstanding loads that may be imparted on the connector 100.

Figure 5:
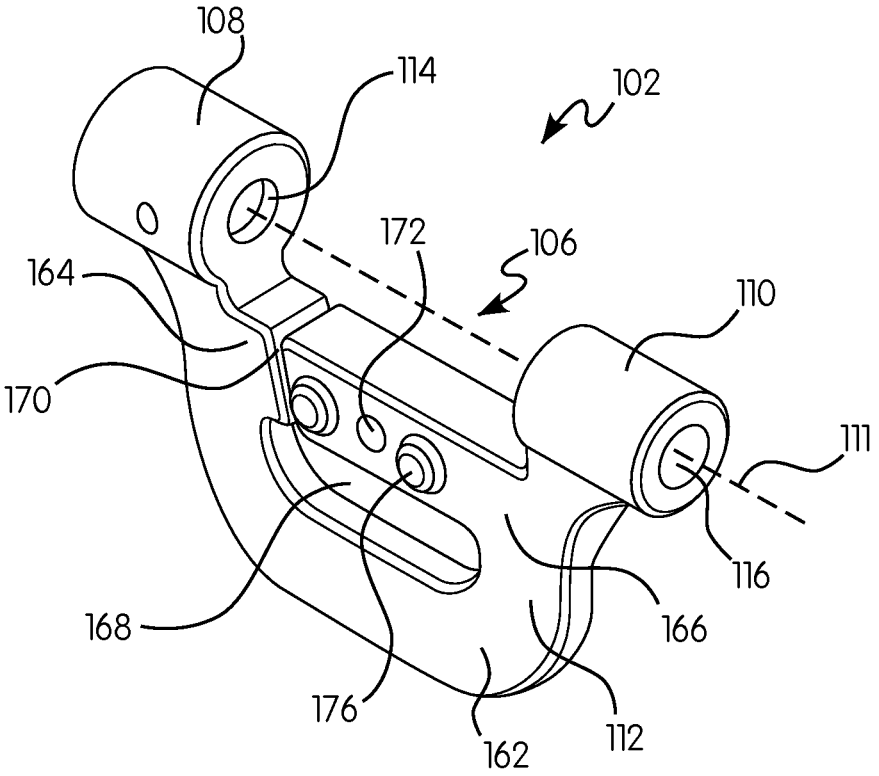
FIG. 5 is a perspective view of a frame of the harness connector illustrated in FIG. 3A.

With reference to FIG. 5, the first end 108 and the second end 110 have a first receiving bore 114 and a second receiving bore 116 extending in a direction along a longitudinal axis 111 of the frame 102. A terminal portion of the first end 108 may be substantially cylindrical with the first receiving bore 114 extending therethrough. Similarly, a terminal portion of the second end 110 may have a substantially cylindrical shape with the second receiving bore 116 extending therethrough. The first receiving bore 114 and the second receiving bore 116 desirably have a cylindrical shape and are coaxial with one another. The first receiving bore 114 and the second receiving bore 116 are configured to slidably receive a gate 118 (shown in FIG. 4). The first receiving bore 114 and the second receiving bore 116 have an inner diameter that is larger than an outer diameter of the body 120 of the gate 118 such that the gate 118 is movable within the first receiving bore 114 and the second receiving bore 116.

With continued reference to FIG. 5, the frame 102 has a connection bar 112 attached to the spine 162. The connection bar 112 has a first end 164 connected to the spine 162 at the first end 108 of the frame 102, and a second end 166 connected to the spine 162 at the second end 110 of the frame 102. The connection bar 112 in conjunction with the spine 162 is configured as a loop having a central opening 168 configured for receiving at least a portion of the energy absorber 101 (shown in FIGS. 1-2). Alternately, other fall arrest/prevention components which themselves incorporate an energy absorber, or components without an energy absorber when the gate is connected to a harness which incorporates an energy absorber, can be connected to opening 168. The connection bar 112 may have a slit 170 extending therethrough to allow insertion of at least a portion of the energy absorber 101, such as an energy absorbing tear tape typically used in fall protection devices, from the pass through opening 106 into the central opening 168. The slit 170 may be dimensioned such that it is wider than the thickness of the portion of the energy absorber 101 that is to be received within the central opening 168 of the connection bar 112. The connection bar 112 may have one or more holes 172 extending therethrough, with each hole 172 configured for removably receiving a fastener 174 (shown in FIG. 4) that connects the first portion 100*a* of the connector 100 with the second portion 100*b*. The one or more holes 172 may be threaded or smooth. The connection bar 112 may further have one or more protrusions 176 that are configured for insertion within the corresponding one or more recesses 178 (shown in FIG. 8) on the second portion 100*b* of the connector 100 to prevent rotation of the first portion 100*a* relative to the second portion 100*b* when the two portions are connected together with the fastener 174.

Figure 9A:
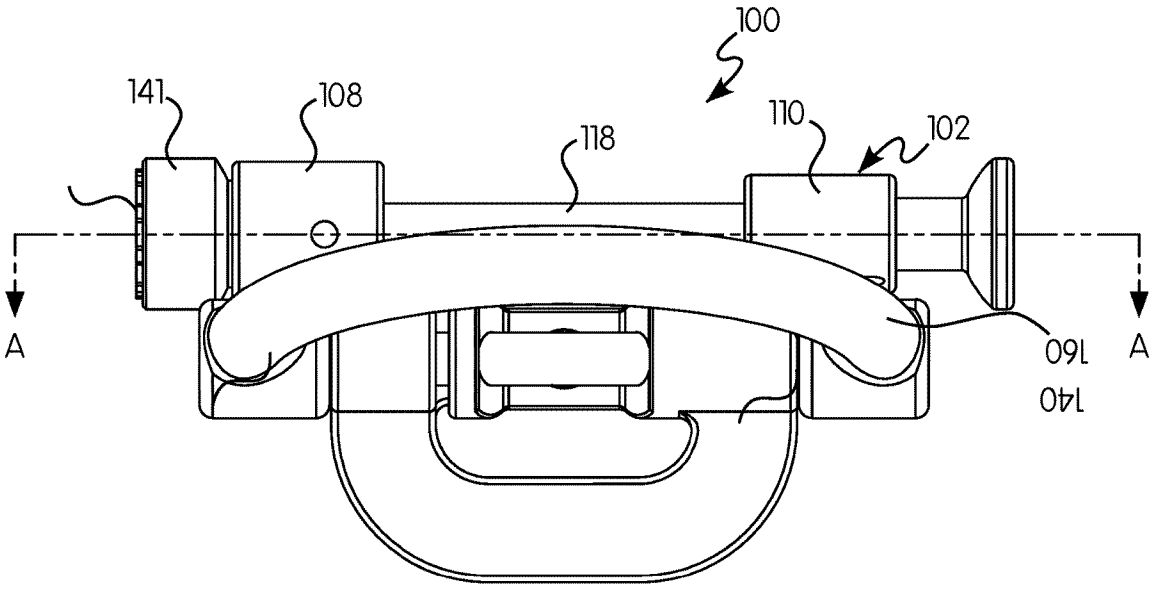
FIG. 9A is a front view of the harness to lanyard connector illustrated in FIG. 3A showing the gate in a closed position and a rotatable knob in a locked position.

The gate 118 is movable relative to the first receiving bore 114 and the second receiving bore 116 between a closed position (FIGS. 9A-9B) to close the pass-through opening 106 and an open position (FIGS. 11A-11B) to open the pass-through opening 106, as discussed herein. With the gate 118 in the closed position, the gate 118 is operatively engaged with the first end 108 and the second end 110 of the frame 102 such that movement of the gate 118 relative to the frame 102 is prevented. In this manner, the gate 118 encloses the opening 106 to prevent a harness strap (not shown) or other element from passing through the opening 106. With the gate 118 in the open position, the gate 118 is freely slidable in a direction of the longitudinal axis 126 of the gate 118 between the first end 108 and the second end 110 of the frame 102. In this manner, the gate 118 can be moved to open the opening 106 and allow a harness strap (not shown) or other element to be inserted through the opening 106.

Figure 6A:
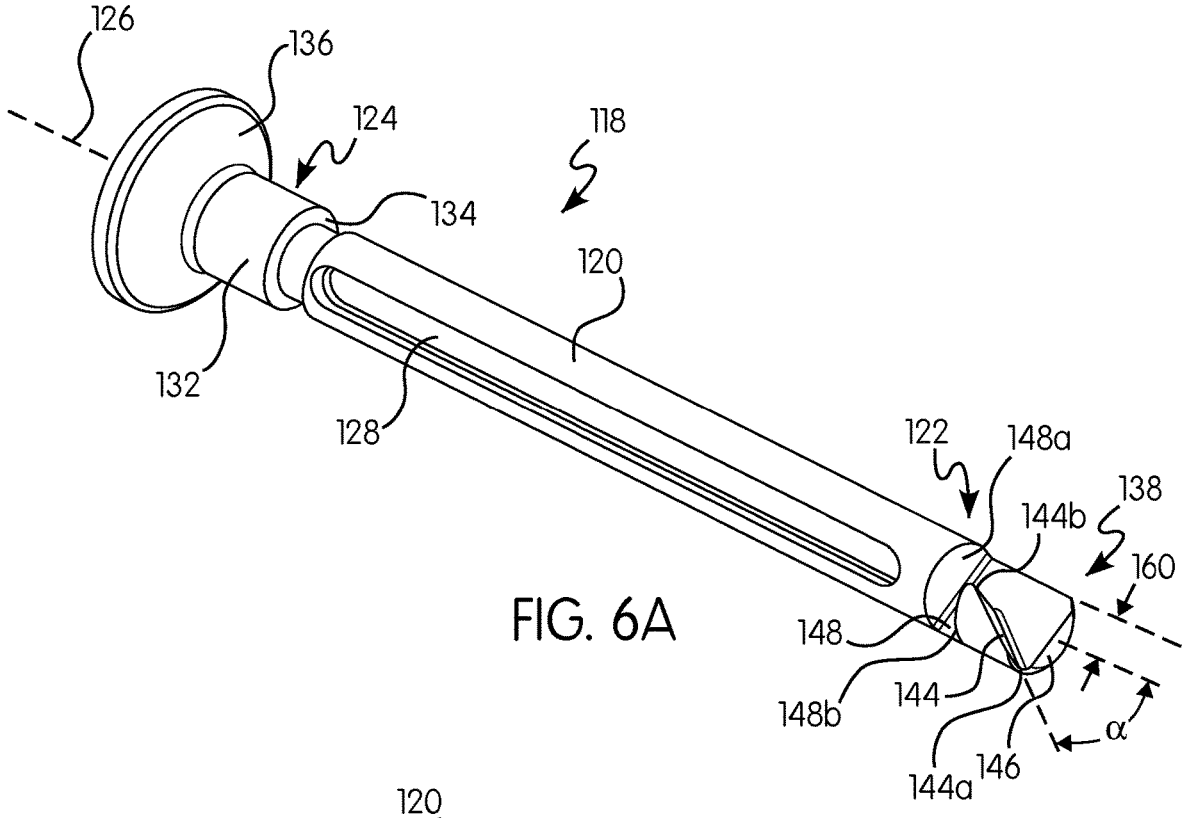
FIG. 6A is a perspective view of a gate configured for use with the harness connector illustrated in FIG. 3A in accordance with one preferred and non-limiting example of the present invention.

With reference to FIG. 6A, the gate 118 is shown in accordance with one preferred and non-limiting embodiment, example, or aspect of the present disclosure. The gate 118 has an elongated, substantially cylindrical body 120 with a first end 122 and a second end 124 spaced apart along a longitudinal axis 126 of the gate 118. The gate 118 has a track 128 extending between the first end 122 and the second end 124 in a direction of the longitudinal axis 126 of the gate 118. The track 128 is configured a channel that is recessed into the body 120 of the gate 118. A detent 130 within the second receiving bore 116 (shown in FIG. 9B) protrudes radially inward from the inner sidewall of the second receiving bore 116 and is received within the track 128. In this manner, the detent 130 prevents rotational movement of the gate 118 while allowing longitudinal movement relative to the frame 102. The detent 130 further prevents removal of the gate 118 from the frame 102 and limits the range of longitudinal movement of the gate 118 relative to the frame 102 based on the length of the track 128. The detent 130 may be removable from the second receiving bore 116 to allow disassembly of the gate 118 from the frame 102.

Figure 9B:
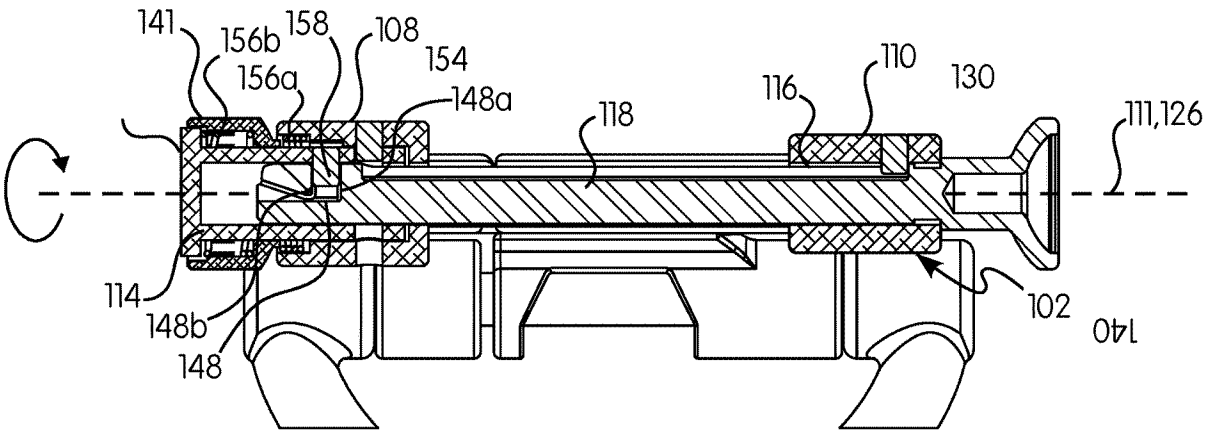
FIG. 9B is a cross-sectional view of the harness to lanyard connector illustrated in FIG. 9A taken along line A-A.

With continued reference to FIG. 6A, the second end 124 of the gate 118 has a gripping portion 132 that protrudes radially outward relative to the body 120 of the gate 118. The gripping portion 132 has a stop end 134 having an outer diameter that is larger than the outer diameter of the body 120 of the gate 118. The stop end 134 may contact the second end 116 of the frame 102 when the gate 118 is in the closed position (FIG. 9B). The gripping portion 132 further has a bulbous terminal end 136 that protrudes radially outward relative to the stop end 134. The terminal end 136 is configured for being grasped between the user's fingers to facilitate movement of the gate 118 relative to the frame 102.

Figure 6B:
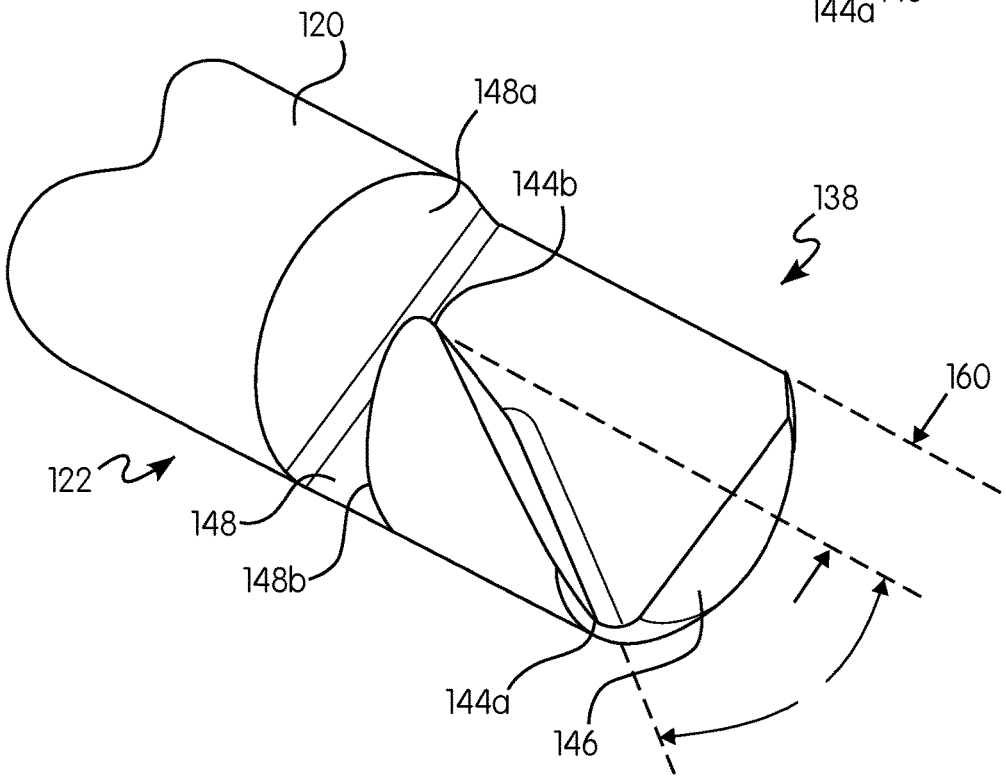
FIG. 6B is an enlarged perspective view of detail "A" shown in FIG. 6A.

With continued reference to FIG. 6A and with reference to FIG. 6B, the first end 122 of the gate 118 has a locking indent 138 configured for interacting with a pin 158 (FIG. 4) of a rotatable knob 140 at the first end 108 of the frame 102. Together, the locking indent 138 and the pin 158 of the rotatable knob 140 define a locking mechanism 142 for selectively locking the gate 118 in the closed position (FIG. 4). The locking indent 138 has a sloped portion 144 that is recessed radially inward into the body 120 of the gate 118. The sloped portion 144 has a first end 144*a* at a terminal end 146 of the first end 122 of the gate 118 and a second end 144*b* opposite the first end 144*a* extending at an angle $\alpha$ relative to the longitudinal axis 126 of the gate 118. In some embodiments or aspects, angle $\alpha$ may be about 15° to about 45. The sloped portion 144 may be substantially linear between the first end 144*a* and the second end 144*b*. The second end 144*b* of the sloped portion 144 opens into a recess 148 that is recessed radially inward into the body 120 of the gate 118 and that is arranged substantially perpendicular to the longitudinal axis 126 of the gate 118. The recess 148 is configured to receive the pin 158 of the rotatable knob 140 (FIG. 4) when the gate 118 is locked with the frame 102. A gap 160 is provided in the recess 148 between the second end 144*b* of the sloped portion 144 and the outer surface of body 120. As described herein, the locking indent 138, defined by the sloped portion 144, the gap 160, and the recess 148, is configured for receiving at least a portion of the rotatable knob when the gate 118 is the in the closed position.

Figure 6C:
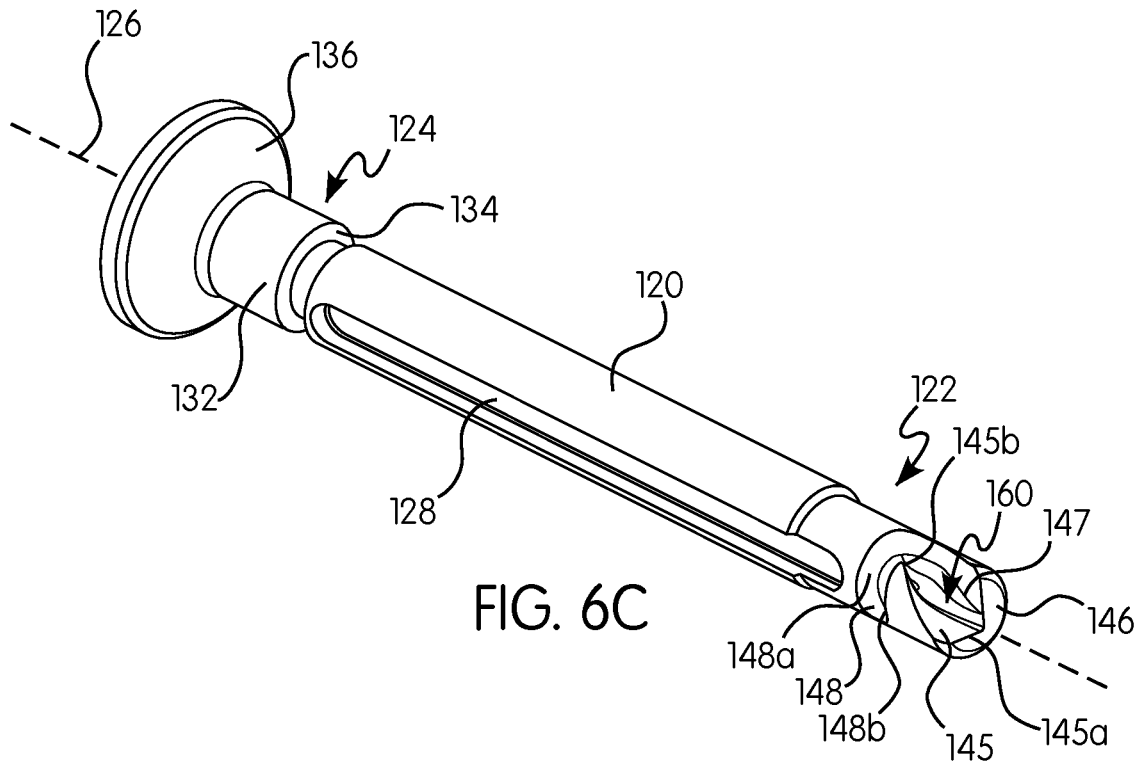
FIG. 6C is a perspective view of a gate configured for use with the harness connector illustrated in FIG. 3A in accordance with one preferred and non-limiting example of the present invention.
Figure 6D:
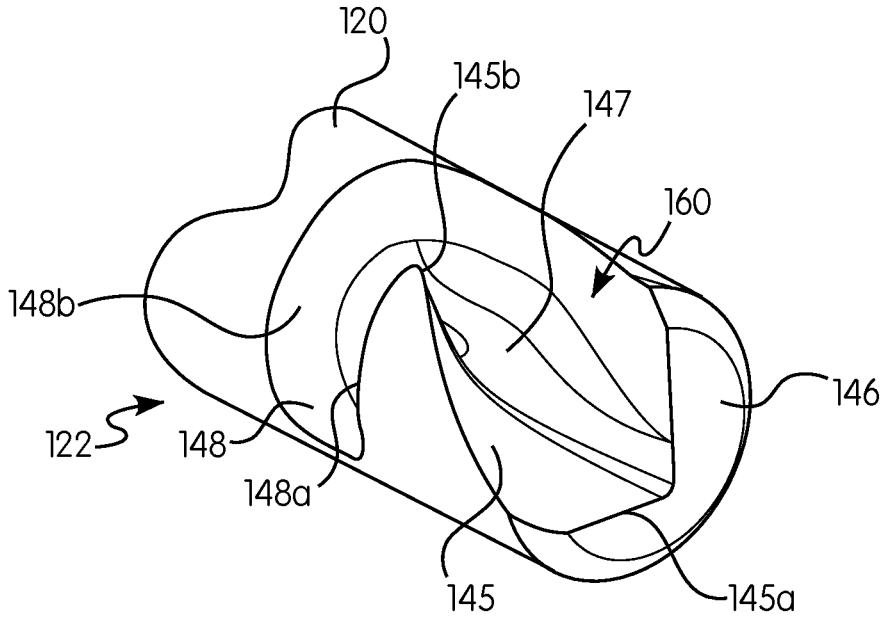
FIG. 6D is an enlarged perspective view of detail "B" shown in FIG. 6C.

With reference to FIGS. 6C-6D, the gate 118 is shown in accordance with another preferred and non-limiting embodiment, example, or aspect of the present disclosure. The components of the gate 118 shown in FIGS. 6C-6D are substantially similar or identical to the components of the gate 118 described herein with reference to FIGS. 6A-6B. As the previous discussion regarding the gate 118 generally shown in FIGS. 6A-6B is applicable to the gate 118 generally shown in FIGS. 6C-6D, only the relative differences between the two gates 118 are discussed hereinafter.

As described herein, the locking indent 138, defined by the sloped portion 145, the gap 160, and the recess 148, is configured for receiving at least a portion of the rotatable knob when the gate 118 is the in the closed position. Whereas the gate 118 in FIGS. 6A-6B has a linear sloped portion 144, the gate 118 in FIGS. 6C-6D has a curved sloped portion 145. The sloped portion 145 is recessed radially inward into the body 120 of the gate 118 from an exterior surface of the body 120. The sloped portion 145 has a first end 145*a* at a terminal end 146 of the first end 122 of the gate 118 and a second end 145*b* opposite the first end 145*a* extending along a curved surface. In some embodiments or aspects, the sloped portion 145 may have a compound curve shape. The shape of the curved surface of the sloped portion 145 is selected to guide the pin 158 of the rotatable knob 140 (FIG. 4) without causing the pin 158 to interfere with any portion of the locking indent 138 as the pin 158 is moved along the curved surface of the sloped portion 145. The second end 145*b* of the sloped portion 145 opens into a recess 148 that is recessed radially inward into the body 120 of the gate 118 from an exterior surface of the body 120. The recess 148 is formed as a pocket that is arranged substantially perpendicular to the longitudinal axis 126 of the gate 118 and is configured to receive the pin 158 of the rotatable knob 140 when the gate 118 is locked with the frame 102. The recess 148 is connected to a gap 160 formed between the sloped portion 145 and a sidewall 147 of the body 120. The gap 160 is configured to guide the pin 158 as the pin 158 moves between the first end 145*a* of the sloped portion 145 and the recess 148.

With reference to FIG. 4, the rotatable knob 140 is connected with the first end 108 of the frame 102 and is rotatable relative thereto about the longitudinal axis 111. In some embodiments or aspects, the rotatable knob 140 is rotatable relative to the frame 102 in one direction only, such as clockwise or counterclockwise, about the longitudinal axis 111. In other embodiments or aspects, the rotatable knob 140 is rotatable relative to the frame 102 in two directions, such as clockwise and counterclockwise, about the longitudinal axis 111. As described herein, the rotatable knob 140 is rotatable between a first position permitting longitudinal movement of the gate 118 between the first end 108 and the second end 110 of the frame 102 and a second position preventing longitudinal movement of the gate 118 when the gate 118 is in the closed position (FIG. 1).

Figure 7:
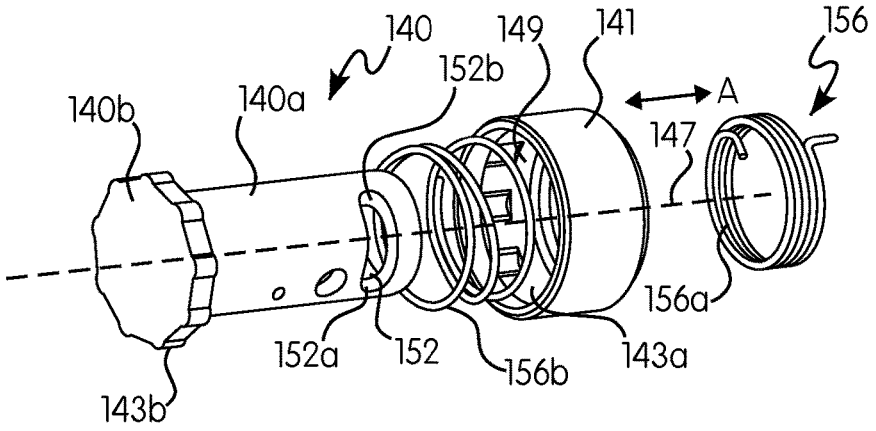
FIG. 7 is a perspective view of a rotatable knob configured for use with the harness connector illustrated in FIG. 3A.
Figure 9C:
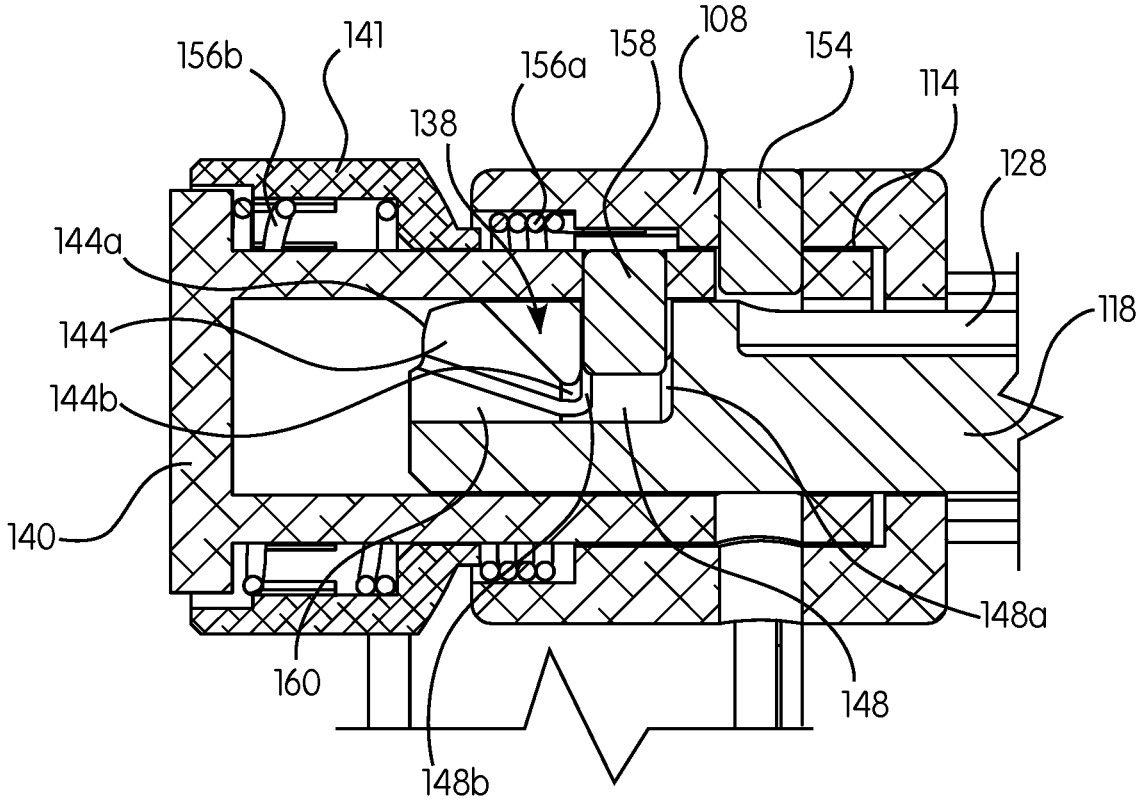
FIG. 9C is a detailed cross-sectional view of the harness to lanyard connector illustrated in FIG. 9B.

With reference to FIG. 7, a first portion 140*a* of the rotatable knob 140 is configured to be inserted into the first receiving bore 114 (shown in FIG. 5) while a second portion 140*b* of the rotatable knob 140 protrudes axially outward from the first receiving bore 114. In some examples, the first receiving bore 114 may have a plurality of portions having different internal diameters (see FIG. 9C). In some examples, the internal diameter of the first receiving bore 114 may increase in a series of steps in a direction from the opening 106 toward a terminal end of the first end 108. The second portion 140*b* of the rotatable knob 140 has a larger outer diameter compared to the inner first portion 140*a* and is configured to slidably connect with an outer sleeve 141 which is to be grasped by the user's fingers for rotating the rotatable knob 140. The first portion 140*a* has a hollow interior with a central opening 150 (shown in FIG. 4) that is configured to receive the first end 122 of the gate 118. Desirably, the inner diameter of the central opening 150 is larger than the outer diameter of the body 120 of the gate 118 such that the gate 118 may be freely inserted into the central opening 150.

With continued reference to FIG. 7, a slot 152 extends through the sidewall of the first portion 140*a* in a circumferential direction of the rotatable knob 140. The slot 152 receives a pin 154 (FIG. 9B) that protrudes radially inward from an inner surface of the first receiving bore 114. The slot 152 and pin 154 secure the rotatable knob 140 axially relative to the frame 102 while allowing rotational movement about the longitudinal axis 111 of the frame 102 delimited by first and second ends 152*a*, 152*b* of the slot 152. In some embodiments or aspects, the rotatable knob 140 may be rotatable about the longitudinal axis 111 over an angular range between about 30° to about 180°. In some embodiments or aspects, the rotatable knob 140 is preferably rotatable about the longitudinal axis 11 over an angular range of about 90° from its initial position.

With continued reference to FIG. 7, the rotatable knob 140 is connected to the outer sleeve 141 having a central opening 149 into which the rotatable knob 140 is inserted. An outer surface of the outer sleeve 141 defines a gripping surface that the user may grip to cause the rotatable knob 140 to rotate about its longitudinal axis 147. The outer sleeve 141 is movable axially relative to the rotatable knob 140 between a first position and a second position in a direction of arrow A shown in FIG. 7. In the first or default position, the outer sleeve 141 is freely rotatable about a longitudinal axis 147 of the rotatable knob 140 without causing the rotatable knob 140 to rotate. The outer sleeve 141 is axially movable relative to the rotatable knob 140 along the longitudinal axis 147 in a direction toward the second portion 140*b* of the rotatable knob 140. In this second position, the outer sleeve 141 and the rotatable knob 140 are operatively connected together in a manner such that rotation of the outer sleeve 141 about the longitudinal axis 147 of the rotatable knob 140 also causes a rotation of the rotatable knob 140.

The outer sleeve 141 may be biased to the first position by a second biasing member 156*b*. In some preferred and non-limiting embodiments or aspects, the second biasing member 156*b* is provided between the rotatable knob 140 and the outer sleeve 141 to axially bias the outer sleeve 141 to the first position. The second biasing member 156*b* may be a spring. When the outer sleeve 141 is moved axially to the second position, the outer sleeve 141 may have first splines 143*a* on its inner surface that connect with the corresponding second splines 143*b* on an outer surface of the rotatable knob 140 such that the rotatable knob 140 and the outer sleeve 141 are in a splined connection. The spacing between the first splines 143*a* and the second splines 143*b* may be equal or unequal. In embodiments or aspects where the spacing between the first splines 143*a* and the second splines 143*b* is unequal, the outer sleeve 141 may be rotated by a predetermined angular amount before the first splines 143*a* on the outer sleeve 141 engage with the second splines 143*b* on the rotatable knob 140. In other embodiments or aspects, the rotatable knob 140 and the outer sleeve 141 may be connected when the outer sleeve 141 is in the second position via any other mechanical connection, such as a hex shape, oval shape, or other arrangement that allows rotation of the rotatable knob 140 about its longitudinal axis 147 with the rotation of the outer sleeve 141.

With continued reference to FIG. 7, the rotatable knob 140 and the outer sleeve 141 are biased to their initial positions by a biasing mechanism 156 having a first biasing member 156*a* and a second biasing member 156*b*. The rotatable knob 140 may be biased to an initial rotational position by the first biasing member 156*a* while the outer sleeve 141 is biased to its first or initial axial position by the second biasing member 156*b*. In some embodiments or aspects, the first biasing member 156*a* may be at least one spring having one end connected to the first end 108 of the frame 102 and a second end connected to the rotatable knob 140. Rotation of the rotatable knob 140 about the longitudinal axis 111 away from the initial position increases a restoring force in the first biasing member 156*a* such that the rotatable knob 140 automatically returns to the initial position after an urging force that displaces the rotatable knob 140 from the initial position is released.

With reference to FIG. 9B, the rotatable knob 140 has a pin 158 protruding radially inward from an inner surface of the central opening 150. The pin 158 is configured for interacting with the locking indent 138 of the gate 118. In particular, the pin 158 is received within the recess 148 of the locking indent 138 when the gate 118 is in the closed position. The pin 158 is retained between first and second ends 148*a*, 148*b* of the recess 148 when the gate 118 is in the closed position to prevent movement of the gate 118 in a direction along its longitudinal axis 126. Rotation of the rotatable knob 140 away from the initial position moves the pin 158 circumferentially within the recess 148 to align the pin 158 with a gap 160 (shown in FIG. 9C) in the recess 148 between the second end 144*b* of the sloped portion 144 and the outer surface of body 120. With the pin 158 positioned in the gap 160, the gate 118 can be withdrawn from the first end 108 of the frame 102 to open the opening 106.

Figure 8:
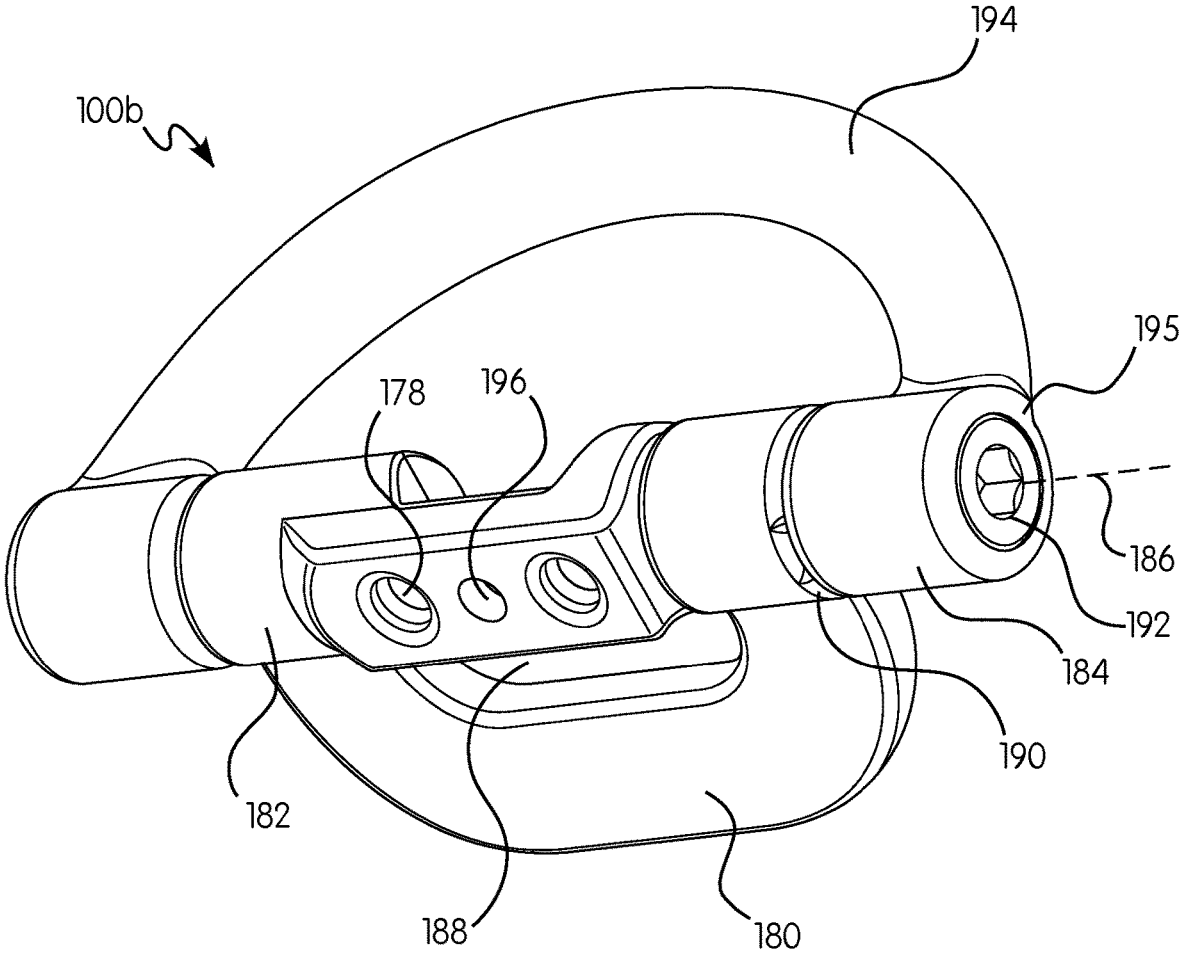
FIG. 8 is a perspective view of a lanyard connector of the harness to lanyard connector illustrated in FIG. 3A.

With reference to FIG. 8, the second portion 100*b* of the connector 100 is shown. As discussed herein, the first portion 100*a* and the second portion 100*b* of the connector 100 may be detachably connected to one another, such as shown in FIG. 2. Similar to the first portion 100*a*, the second portion 100*b* of the connector 100 may be configured for connecting with the second portion 101*b* of the fall arrest/prevention energy absorber 101, and a safety line, or a lanyard.

With continued reference to FIG. 8, the second portion 100*b* has a frame 180 having a substantially D-shaped form. The frame 180 has a first end 182 and a second end 184 spaced apart along a longitudinal axis 186 of the frame 180 and an opening 188 defined between the first end 182 and the second end 184. The opening 188 is configured for receiving at least a portion of the fall arrest/prevention energy absorber 101 (shown in FIGS. 1-2). The frame 180 may be formed as a single, unitary component. The frame 180 may be made from metal, composite, combination of metal and composite, or other heavy duty material capable of withstanding loads that may be imparted on the connector 100.

With continued reference to FIG. 8, the first end 182 and the second end 184 have a bore 190 extending therethrough in a direction along the longitudinal axis 186. The bore 190 is configured to receive a fastener 192 connecting a lanyard connector 194 to the frame 180. The bore 190 desirably has an inner diameter that is larger than an outer diameter of the fastener 192 such that the fastener 192 can be freely inserted into the bore 190. The lanyard connector 194 may be movable relative to the frame 180, such as by being rotatable about the longitudinal axis 186 of the frame 180. The lanyard connector 194 may be arcuately shaped and provide a connecting point for additional fall arrest/prevention components. Similar to the frame 180, the lanyard connector 194 may have a bore 195 for receiving the fastener 192. At least one end of the bore 195 may have a threaded portion 197 (shown in FIG. 4) for threadably connecting with the lanyard connector 194. The frame 180, fastener 192, and lanyard connector 194 may be formed as a single unitary component.

With continued reference to FIG. 8, the frame 180 may have one or more holes 196 extending therethrough, with each hole 196 configured for removably receiving the fastener 174 (shown in FIG. 4) that connects the first portion 100*a* of the connector 100 with the second portion 100*b*. The frame 180 further may have one or more recesses 178 that are configured for receiving the corresponding one or more protrusions 176 on the first portion 100*a* of the connector 100 to prevent rotation of the first portion 100*a* relative to the second portion 100*b* when the two portions are connected together with the fastener 174. In some embodiments or aspects, the one or more protrusions 176 may be provided on the second portion 100*b* while the one or more recesses 178 may be provided on the first portion 100*a*.

Figure 10A:
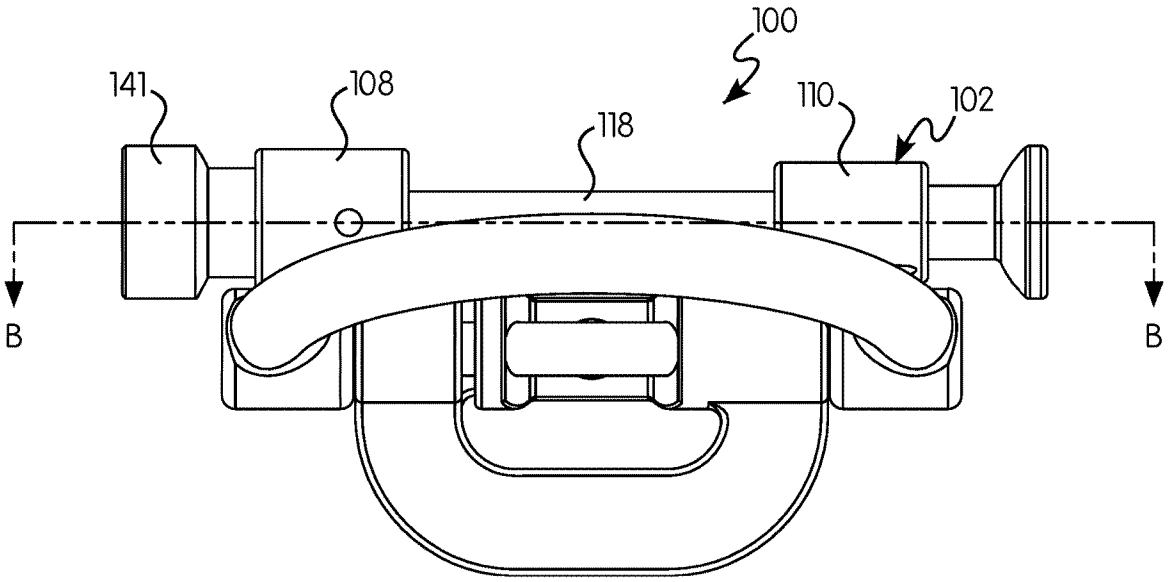
FIG. 10A is a front view of the harness to lanyard connector illustrated in FIG. 3A showing the gate in the closed position and the outer sleeve rotationally locked with the rotatable knob and the rotatable knob in a locked position.
Figure 10B:
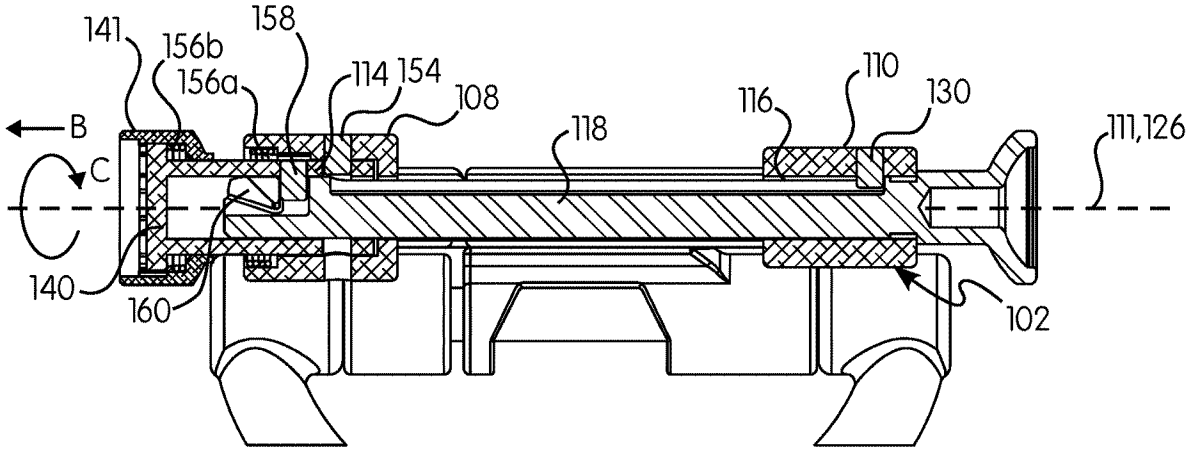
FIG. 10B is a cross-sectional view of the harness to lanyard connector illustrated in FIG. 10A taken along line B-B.

Having described the structure of the connector 100, the method of operation of the connector 100 from a first position permitting longitudinal movement of the gate 118 between the first end 108 and the second end 110 of the frame 102 and a second position preventing longitudinal movement of the gate 118 will now be described with reference to FIGS. 9A-11B. While FIGS. 9A-11B show the connector 100 having the gate 118 shown in FIGS. 6A-6B, it is to be understood that the gate 118 shown in FIGS. 6C-6D can be substituted for the gate 118 of FIGS. 6A-6B without departing from the intended method of operation of the connector 100. When the rotatable knob 140 is in its initial position and when the gate 118 is in the closed position (FIGS. 9A-9C), the pin 158 on the rotatable knob 140 is retained between first and second ends 148*a*, 148*b* of the recess 148 on the gate 118. In this manner, axial movement of the gate 118 along the longitudinal axis 126 is prevented and the opening 106 on the frame 102 remains closed. To release the gate 118 from the closed position (FIGS. 9A-9C), the outer sleeve 141 is moved axially from the first position (FIG. 9B) to the second position (FIG. 10B) by pulling the outer sleeve 141 in the direction of arrow B shown in FIG. 10B. Once the outer sleeve 141 is operatively engaged with the rotatable knob 140, such as due to interaction between the first splines 143*a* on the outer sleeve 141 and the second splines 143*b* on the rotatable knob 140 described herein with reference to FIG. 7, the outer sleeve 141, along with the rotatable knob 140, is rotated relative to the frame 102 about the longitudinal axis 111 of the frame 102 in an opening direction, such as by rotating the outer sleeve 141 and the rotatable knob 140 clockwise or counterclockwise in a direction of arrow C in FIG. 10B (only clockwise direction is shown in FIG. 10B). In this manner, two discrete actions are required to unlock the pin 158 on the rotatable knob 140 from the recess 148 on the gate 118. The two discrete actions can be completed using one hand, thereby freeing the other hand to pull the gate 118.

As discussed herein, the rotatable knob 140 may be rotatable in one direction only (the opening direction) from its initial position toward a first position. Such rotation of the rotatable knob 140 generates a restoring force in the first biasing member 156*a*. Rotation of the rotatable knob 140 in a direction opposite to the opening direction may be prevented due to interaction between the rotatable knob 140 and the first end 108 of the frame 102, such as due to the positioning on the pin 154 that protrudes from the inner surface of the first receiving bore 116 into the slot 152 on the rotatable knob 140 when the rotatable knob 140 is in its initial position.

Figure 11A:
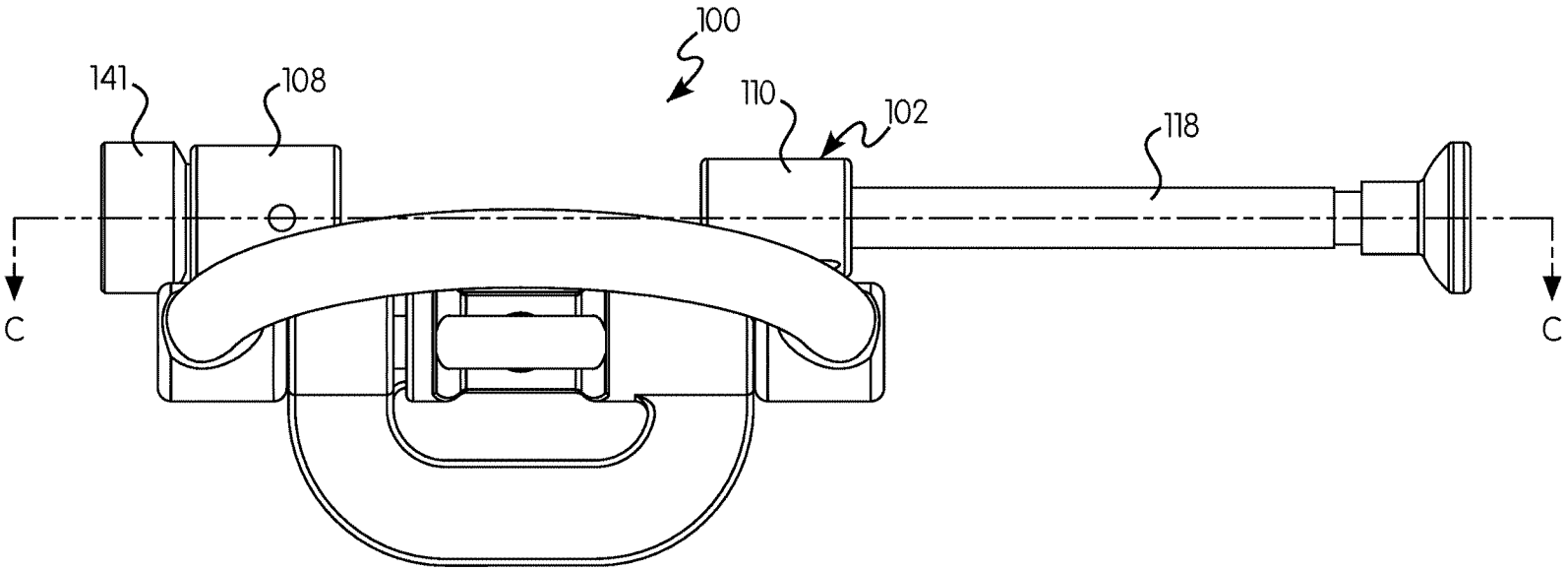
FIG. 11A is a front view of the harness to lanyard connector illustrated in FIG. 3A showing the gate in an open position.
Figure 11B:
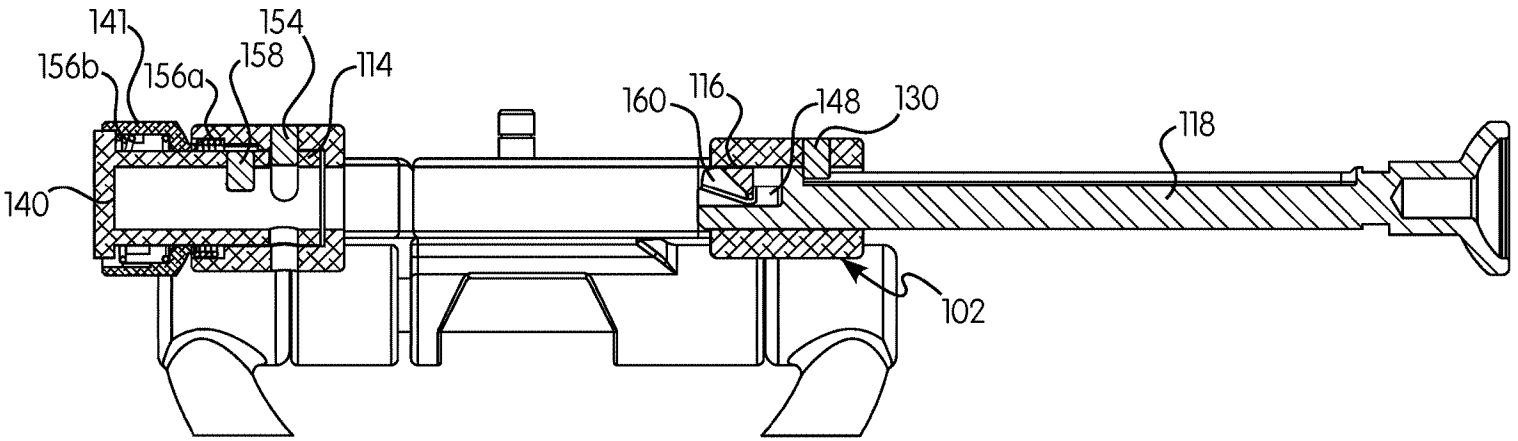
FIG. 11B is a cross-sectional view of the harness to lanyard connector illustrated in FIG. 11A taken along line C-C.

With rotation of the rotatable knob 140 in the opening direction toward the first position (FIGS. 10A-10B), the pin 158 on the rotatable knob 140 is moved circumferentially within the recess 148 on the gate 118. Once the pin 158 is aligned with the gap 160 (shown in FIGS. 6B and 6D) in the recess 148 between the first end 148*a* of the recess 148 and the second end 144*b* of the sloped portion 144 (shown in FIGS. 6B and 6D) of the locking indent 138 on the gate 118, the gate 118 can be withdrawn from the first end 108 of the frame 102 by moving the gate 118 axially out of the first receiving bore 114 (FIGS. 11A-11B). In this manner, a third operation is necessary to unlock and open the gate 118 from the frame 102—one axial movement of the outer sleeve 141 relative to the rotatable knob 140, one rotational movement of the outer sleeve 141 and the rotatable knob 140, and one axial movement of the gate 118 following the rotation of the outer sleeve 141 and the rotatable knob 140.

By moving the gate 118 out of the first end 108 of the frame 102, the opening 106 is opened to allow insertion of an element of a fall arrest/prevention system, such as one or more straps of a fall protection harness. As the gate 118 is moved out of the first receiving bore 114, the rotatable knob 140 can be released from the first position to be restored to a second position (initial position) due to the restoring force of the biasing mechanism 156. After unlocking the gate 118 from the first end 108 of the frame 102, the gate 118 can be freely moved in an axial direction along its longitudinal axis 126. As discussed herein, axial movement of the gate 118 away from the second end 110 is delimited by the interaction between the detent 130 within the second receiving bore 116 and the track 128 on the body 120 of the gate 118.

To close the gate 118, the gate 118 is moved axially along its longitudinal axis 126 toward the first end 108 of the frame 102. The rotatable knob 140 is positioned in the second (initial) position, where the pin 158 of the rotatable knob 140 is positioned in the path of travel of the gate 118. Specifically, the position of the pin 158 within the first receiving bore 114 prevents further axial movement of the gate 118 due to interference between the pin 158 and the sloped portion 144 of the gate 118. The rotatable knob 140 may be rotated manually, such as by physically rotating the outer sleeve 141 and the rotatable knob 140 toward the first position, or automatically, such as due to contact between the sloped portion 144 of the locking indent 138 on the gate 118 with the pin 158 on the rotatable knob 140. With manual rotation of the outer sleeve 141 and the rotatable knob 140, the rotatable knob 140 is rotated about the longitudinal axis 111 to circumferentially align the pin 158 with the gap 160 (shown in shown in FIGS. 6B and 6D) on the locking indent 138 and allow further axial movement of the gate 118 into the gap 160 until the pin 158 contacts the second end 148*b* of the recess 148. With automatic rotation of the rotatable knob 140, the user pushes on the second end 124 of the gate 118 to move the sloped portion 144 of the locking indent 138 into contact with the pin 158. The axially-directed force on the second end 124 of the gate 118 applies a force to pin 158, and thereby the rotatable knob 140, causing rotatable knob 140 to rotate such that the gate 118 can slide along the pin 158 on the sloped portion 144 until the pin 158 enters the gap 160 on the locking indent 138 and contacts the second end 148*b* of the recess 148. Once the pin 158 engages the second end 148*b* of the recess 148, the position of the rotatable knob 140 is restored to its original state due to the restoring force of the biasing mechanism 156. With the rotatable knob 140 in its initial position, the gate 118 is locked in the closed position, thereby preventing access in and out of the opening 106.

Although the invention has been described in detail for the purpose of illustration based on what are currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment or aspect can be combined with one or more features of any other embodiment or aspect.

The invention claimed is:

1. A connector comprising:

a frame having a first end, a second end, and a pass-through opening extending between the first end and the second end along a longitudinal axis of the frame, a gate positioned within the pass-through opening between the first end and the second end of the frame and movable axially relative to the frame between a closed position to close the pass-through opening and an open position to open the pass-through opening; and a locking mechanism for selectively locking the gate in the closed position, the locking mechanism comprising:

a rotatable knob connected to at least one of the first end and the second end of the frame and rotatable relative to the frame in a direction about the longitudinal axis;

an outer sleeve surrounding at least a portion of the rotatable knob, the outer sleeve axially movable relative to the rotatable knob between a first position and a second position, wherein, in the first position of the outer sleeve, rotational movement of the rotatable knob is prevented, and wherein, in the second position of the outer sleeve, rotational movement of the rotatable knob is permitted; and a locking indent on the gate configured for receiving at least a portion of the rotatable knob when the gate is in the closed position, the locking indent comprising a curved sloped portion arranged at an angle relative to a longitudinal axis of the gate and a recess arranged substantially perpendicular to the longitudinal axis of the gate, wherein the rotatable knob is rotatable between a first position permitting longitudinal movement of the gate between the first end and the second end of the frame and a second position preventing longitudinal movement of the gate when the gate is in the closed position.

2. The connector of claim 1, wherein, in the closed position, the gate is connected to the first end and the second end of the frame, and wherein, in the open position, the gate is disconnected from at least one of the first end and the second end of the frame.

3. The connector of claim 1, wherein the rotatable knob comprises a pin positioned within at least one of the first end and the second end of the frame.

4. The connector of claim 1, wherein the rotatable knob is biased to the second position by a first biasing member.

5. The connector of claim 4, wherein the first biasing member is a spring.

6. The connector of claim 1, wherein the outer sleeve is operatively connected with the rotatable knob in the second position of the outer sleeve to permit rotational movement of the rotatable knob with rotational movement of the outer sleeve.

7. The connector of claim 1, wherein the outer sleeve is axially biased to the first position by a second biasing member.

8. The connector of claim 1, wherein the gate has an elongated, substantially cylindrical body with a first end and a second end spaced apart along a longitudinal axis of the gate.

9. The connector of claim 8, wherein the locking indent is positioned at one of the first end and the second end of the gate.

10. The connector of claim 8, wherein the locking indent comprises a gap between the curved sloped portion and a sidewall of the gate and wherein a pin of the rotatable knob is guided within the gap along the curved or straight sloped portion.

11. The connector of claim 8, wherein the cylindrical body of the gate is movable within a bore extending through the first end and the second end of the frame.

12. The connector of claim 8, wherein the gate comprises a track extending between the first end and the second end in a direction of the longitudinal axis.

13. The connector of claim 12, wherein the frame comprises a detent within a bore of at least one of the first end and the second end of the frame, the detent received within the track of the gate to delimit longitudinal and rotational movement of the gate relative to the frame.

14. The connector of claim 1, wherein the frame has an attachment portion with an opening for receiving an element of a fall arrest system.

15. A connector comprising:

a frame having a first end, a second end, and a pass-through opening extending between the first end and the second end along a longitudinal axis of the frame, a gate positioned within the pass-through opening between the first end and the second end of the frame, the gate having an elongated, substantially cylindrical body with a first end and a second end spaced apart along a longitudinal axis of the gate, the gate being movable axially relative to the frame between a closed position, wherein the gate is connected to the first end and the second end of the frame, and an open position, wherein the gate is disconnected from at least one of the first end and the second end of the frame; and a locking mechanism for selectively locking the gate in the closed position, the locking mechanism comprising:

a rotatable knob connected to at least one of the first end and the second end of the frame and rotatable relative to the frame in a direction about the longitudinal axis between a first position permitting longitudinal movement of the gate between the first end and the second end of the frame and a second position preventing longitudinal movement of the gate when the gate is in the closed position, the rotatable knob having a pin positioned within a bore of at least one of the first end and the second end of the frame;

an outer sleeve surrounding at least a portion of the rotatable knob, the outer sleeve axially movable relative to the rotatable knob between a first position and a second position, wherein, in the first position of the outer sleeve, rotational movement of the rotatable knob is prevented, and wherein, in the second position of the outer sleeve, rotational movement of the rotatable knob is permitted; and a locking indent on one of the first end and the second end of the cylindrical body of the gate, the locking indent comprising a curved sloped portion arranged at an angle relative to the longitudinal axis of the gate and a recess arranged substantially perpendicular to the longitudinal axis of the gate, the recess configured for receiving the pin of the rotatable knob when the gate is in the closed position, wherein the rotatable knob is biased to the second position by a first biasing member.

16. The connector of claim 15, wherein the first biasing member is a spring.

17. The connector of claim 15, wherein the cylindrical body of the gate is movable within a bore extending through the first end and the second end of the frame.

18. The connector of claim 15, wherein the gate comprises a track extending between the first end and the second end in a direction of the longitudinal axis, wherein the frame comprises a detent within the bore of at least one of the first end and the second end of the frame, and wherein the detent is received within the track of the gate to delimit longitudinal and rotational movement of the gate relative to the frame.

19. The connector of claim 15, wherein the outer sleeve is operatively connected with the rotatable knob in the second position of the outer sleeve to permit rotational movement of the rotatable knob with rotational movement of the outer sleeve.

20. The connector of claim 19, wherein the outer sleeve is axially biased to the first position by a second biasing member.

21. A connector comprising:

a frame having a first end, a second end, and a pass-through opening extending between the first end and the second end;

a gate positioned within the pass-through opening between the first end and the second end of the frame and movable axially relative to the frame between a closed position to close the pass-through opening and an open position to open the pass-through opening; and a locking mechanism for selectively locking the gate in the closed position, the locking mechanism comprising:

a rotatable knob connected to at least one of the first end and the second end of the frame and rotatable relative to the frame in a direction about a longitudinal axis, the rotatable knob having a pin positioned within a bore of at least one of the first end and the second end of the frame;

an outer sleeve surrounding at least a portion of the rotatable knob, the outer sleeve axially movable relative to the rotatable knob between a first position and a second position, wherein, in the first position of the outer sleeve, rotational movement of the rotatable knob is prevented, and wherein, in the second position of the outer sleeve, rotational movement of the rotatable knob is permitted; and a locking indent on the gate comprising a curved sloped portion arranged at an angle relative to a longitudinal axis of the gate and a recess arranged substantially perpendicular to the longitudinal axis of the gate, wherein the recess is configured for receiving the pin of the rotatable knob when the gate is in the closed position, wherein the rotatable knob is rotatable between a first position permitting longitudinal movement of the gate between the first end and the second end of the frame and a second position preventing longitudinal movement of the gate when the gate is in the closed position.

22. The connector of claim 21, wherein the rotatable knob is rotationally biased by a first biasing member.

23. The connector of claim 22, wherein the first biasing member is a spring.

24. The connector of claim 21, wherein the outer sleeve is axially biased to the first position by a second biasing member.

* * * * *